United States Patent [19]

Puhak

[11] Patent Number: 4,461,971

[45] Date of Patent: Jul. 24, 1984

[54] STRENGTHENING MEANS FOR A CRT MULTI-OPENING MASK FRAMING MEMBER

[75] Inventor: Peter G. Puhak, Seneca Falls, N.Y.

[73] Assignee: North American Philips Consumer Electronics Corp., New York, N.Y.

[21] Appl. No.: 405,131

[22] Filed: Aug. 4, 1982

[51] Int. Cl.[3] ..... H01J 29/81

[52] U.S. Cl. ..... 313/407; 313/402

[58] Field of Search ..... 313/407, 402, 404

[56] References Cited

U.S. PATENT DOCUMENTS

| | | | |
|---|---|---|---|
| 3,737,703 | 6/1973 | Tsuneta et al. | 313/407 |
| 3,873,874 | 3/1975 | Shinal | 313/407 X |
| 4,099,086 | 7/1978 | Röder et al. | 313/407 |
| 4,362,963 | 12/1982 | Puhak | 313/407 |

*Primary Examiner*—Eugene R. LaRoche
*Assistant Examiner*—Vincent DeLuca
*Attorney, Agent, or Firm*—Thomas A. Briody; Jack Oisher; John C. Fox

[57] ABSTRACT

The invention is a structural improvement in the framing member of a rectangular color CRT mask-frame assembly. The improvement, which promotes rigidity in the framing member, is in the form of a continuous perimetrical channel-like indentation extending along the major and minor related elements of the framing member. The beneficial corner mergings of the respective channel-like indentations are effected by discretely shaped "S"-like arcuate channel-like formations which are oriented substantially relative to the flow of the formed material thereat.

12 Claims, 6 Drawing Figures

STRENGTHENING MEANS FOR A CRT MULTI-OPENING MASK FRAMING MEMBER

TECHNICAL FIELD

This invention relates to the framing member of a cathode ray tube (CRT) substantially rectangular multi-opening mask-frame assembly and more particularly to improved means for perimetrically strengthening the rectangular framing member to impart greater rigidity thereto.

BACKGROUND OF THE INVENTION

In multibeam color cathode ray tubes, it is conventional practice to utilize an internal multi-opening component, such as an aperture mask, in the forward portion of the tube. Such is suitably supported within the tube envelope in spaced relationship to an adjacent patterned cathodoluminescent screen disposed on the interior surface of the tube display area or viewing panel. Common types of patterned screens utilized with the above-mentioned multi-opening component may be comprised of a multitude of dot triads, or stripes of different color emitting phosphors disposed as an array on the viewing panel in a predetermined repetitive sequence in related registry with the apertures in the multi-opening mask. The alignment relationship of the openings with the adjacent elements of the screen pattern is a requisite for the subsequent phosphor excitation by the specific electron beams directed thereto.

The term "aperture" or "opening" as used herein, is given a broad connotation to include those discretely formed mask openings that are substantially round, ovate, or slot-like shapings, some versions of which may be delineated by a supported array of spatially-related wires or strips.

The multi-opening portion of the mask-frame assembly is usually a substantially domed structure which is affixed to a substantially rigid metallic perimetrical supporting or framing member. This essential supporting member is usually a one-piece drawn structure representing an integration of top, bottom, and side elements transitionally combined at angular corner regions to provide a continuous sidewall portion, shaped to mate with the domed multi-opening portion which is bonded thereto to complete the mask-frame assembly. The structure of the framing member manifests a substantially L-shaped cross-sectional configuration by reason of a ledge portion instanding from the sidewall portion. The assembly is then positioned, by a plurality of support means, within the tube viewing panel in close proximity to the patterned cathodoluminescent screen disposed therein.

By the inherent constructional shaping of the framing member, structurally weaker areas are evidenced in the corners and immediately adjacent regions. This structural weakness is the result of the designed reduction of material in those areas and the drawn shaping which tends to somewhat further reduce the material thickness thereat. Thus, as a result of these weakening factors, the stresses induced by the drawing procedure often impart a slight twist or warp to the corner regions. When the multi-opening mask portion is affixed to the framing member, in the mask-to-frame assembly procedure, mechanical jigging is utilized to seat the framing member into a planar position prior to consummation of the bonding. However, when the mask-frame assembly is subsequently lehr-heated during the glass panel-to-funnel sealing procedure, the constraining influences of the mask portion are lessened, whereupon the stressing forces in the framing member tend to again assume prominence and thereby produce undesirable corner-oriented twisting. This becomes more pronounced as the size of the framing member is increased. Any warpage or twisting of the mask-frame assembly within the tube causes misalignment of the mask openings with the respective phosphor elements of the patterned screen, thereby deleteriously affecting both resolution and color purity of the screen display.

Prior art techniques to overcome the aforementioned twisting action include the incorporation of straight strength ribs in the corner regions, such being oriented substantially perpendicular to a diagonal bisector therethrough, and as such, cut across the flow lines of the corner material. Additionally, the usual deep shaping of the ends of such ribs tends to unduly stretch the material in the corners, thereby introducing additional stresses which, in themselves, tend to aggravate warpage when released during tube processing.

An advancement in the art is taught by Peter G. Puhak in U.S. patent application Ser. No. 241,176, filed Mar. 6, 1981, now U.S. Pat. No. 4,362,963 and assigned to the assignee of this invention. Puhak discloses the use of a substantially crescent-shaped strengthening indentation formed in each corner of the framing member. Such indentations have open concave edges facing the central opening of the framing member, and rounded and sloped termini. These crescent shapings have markedly strengthened the framing members employed in the smaller sized tubes, such as the 12 and 15 inch screen sizes. But, in the larger tubes, such as the 19 and 25 inch sizes, wherein increased leverage of the framing side members is evidenced, it has been found that additional strengthening of the mask-framing member is desired.

DISCLOSURE OF THE INVENTION

It is therefore an object of the invention to provide improved strengthening for the framing members used in the CRT mask-frame assemblies, particularly the larger sizes thereof. Another object is to achieve increased frame rigidity and a resultant consistency of improved tube quality.

These and other objects and advantages are accomplished in one aspect of the invention by incorporating conjunctive strengthening means in the corners and the associated peripherally-related regions of the framing member.

To provide a setting for the invention, the structural aspects of a framing member will be presented in greater detail. An exemplary framing member of a mask-frame assembly is one comprised of an integration of major dimensionally-related elements and minor dimensionally-related elements transitionally combined at corner regions to provide a continuous supporting structure. Conventionally, the member evidences a substantially L-shaped cross-sectional configuration having a formed ledge portion instanding from the upstanding sidewall portion. This ledge has an exterior surface and an interior surface with which the sidewall portion is in substantially perpendicular relationship. Additionally, the ledge evidences a continuous inner edge which defines the central opening of the framing member. The aforementioned sidewall has a terminal contour whereto the multi-opening member of the assembly is subsequently positioned and affixed.

The invention relates to a structural improvement of the framing member whereby greater rigidity is imparted thereto by effecting perimetrical strengthening thereof. Such is provided by forming a longitudinal channel-like indentation in the ledge portion of the framing member in each of the major and minor related elements in a manner to extend toward the corner regions of the member. The ends of the respective major and minor related channel-like indentations are joined at the respective corner regions by an "S"-like arcuate corner indentation so positioned as to merge with the respective ends of the major and minor related channels to form a continuous indentation in each corner region.

Each of the respective ledge-oriented major and minor related channel-like indentations is preferably of a substantially arcuate cross-section evidencing defined width and depth dimensions, and is located in substantially equi-spaced adjacency to the respective inner edge of the ledge. As such, each channel-like indentation produces a complementary protrusion from the opposed surface of the ledge portion that exceeds the thickness of the ledge material. These indentations may be formed either inward from the exterior surface of the ledge portion or outward from the interior surface thereof. Being formed in the desired orientation, all of the channel-like indentations are usually sequentially joined to form a continuous channel, but the channel may evidence optional short discontinuances at selected areas, for example, to accommodate the inclusion of apertures for beam shield anchoring means in the ledge, if such are deemed necessary.

To further delineate the corner "S"-like indentations, each is formed with one part of the "S" accentuated as a substantially laterally expanded arcuate indentation directed toward the outer peripheral edge of the framing member. The corner channel width dimension, at substantially the mid point thereof, is greater than the normal width dimensions of the associated major and minor related channel-like indentations. To impart optimum rigidity to the framing member, the respective major and minor related channels merge with the adjoining "S"-like arcuate corner indentation in substantially tangential relationship.

The perimetrical combination of channel-like indentations and the discrete corner transitions therebetween effects a strengthening of the framing member in a manner not heretofore achieved.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
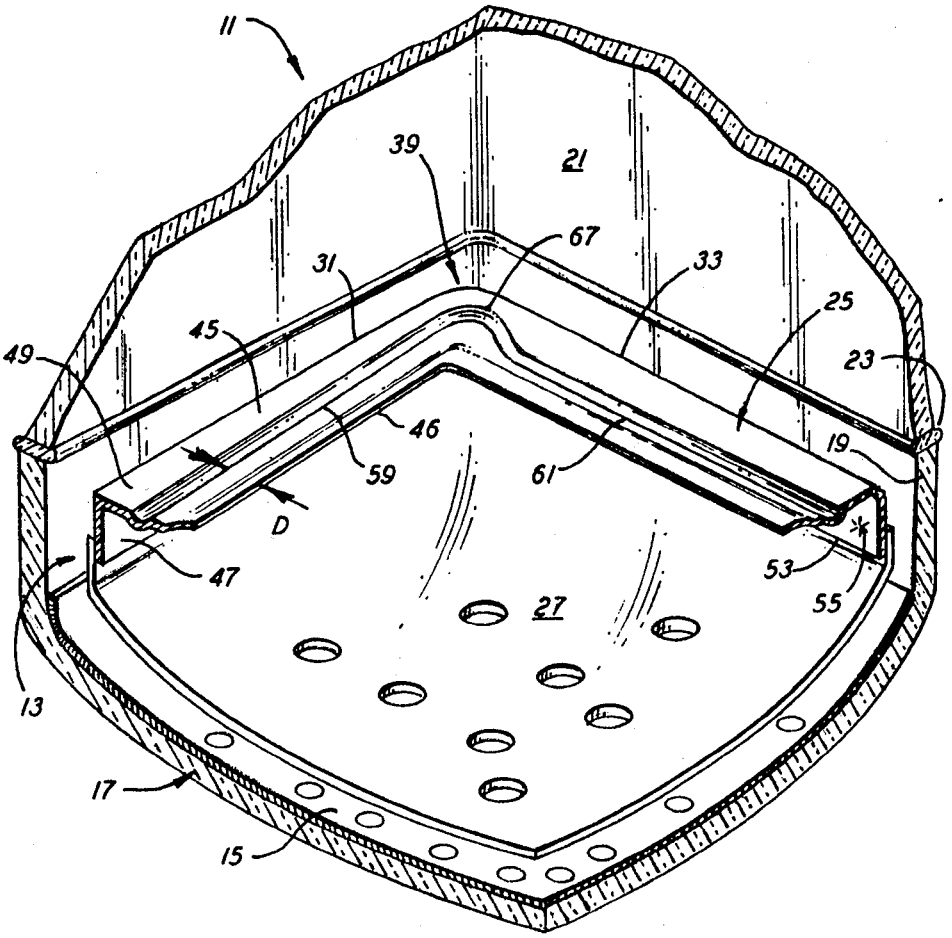
FIG. 1 is a partial sectional perspective illustration of a color CRT showing the orientation of the invention.

With reference to the drawings, there is shown in FIG. 1 a partially sectioned portion of a conventional color cathode ray tube 11 of the type employing a substantially rectangular multi-opening mask-frame assembly 13, such being spatially related to a patterned cathodoluminescent screen 15 disposed upon the interior surface of the tube viewing panel 17.

In greater detail, the mask-frame assembly 13, which is spacedly positioned within the viewing panel 17 of the tube envelope, is suitably supported therein relative to the panel sidewall 19 by means not shown. The panel with the mask-frame assembly positioned therein, is hermetically joined with the forward edge of the tube envelope funnel portion 21 by frit sealing means 23 to complete the tube construction as illustrated in FIG. 1.

The mask-frame assembly 13 is comprised of a metallic framing member 25, fabricated for example of substantially 0.0478 inch (1.214 mm) cold rolled steel, to which is attached the substantially domed multi-opening mask or grid-like portion 27. While this multi-opening portion is shown to have substantially circular openings therein, such is not limiting as the openings may also be of ovate or elongated slot-like shapings in keeping with the associated screen pattern desired.

As illustrated in the drawings, the substantially rectangular framing member 25 is formed of an integration of two major dimensionally-related elements 29, 31, and two minor dimensionally-related elements 33, 35. These several elements are transitionally combined at angular corner regions 37, 39, 41 and 43 to provide a continuous perimetrical supporting structure for the assembly 13.

Figure 2:
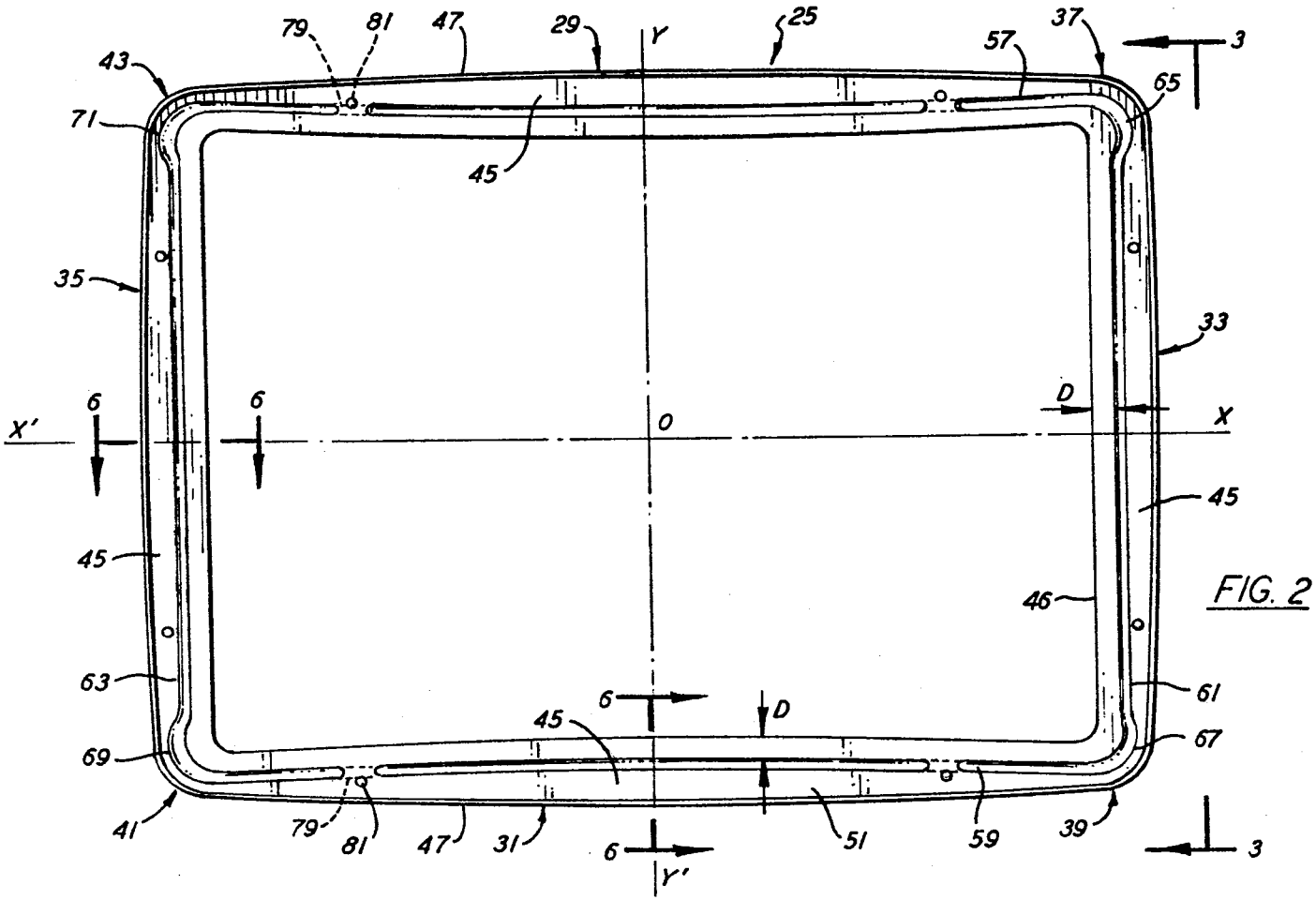
FIG. 2 is a plan view of a rectangular perimetrical framing member as utilized in a color CRT mask-frame assembly.

From a central point of origin O, reference X-X' and Y-Y' axes are provided in the plane of the framing member as indicated in FIG. 2. The exemplary rectangular framing member is shown as having the major related elements 29 and 31 thereof oriented in parallel relationship with the X-X' axis. Such is not to be considered limiting, as there may be tube constructions and applications wherein the screen display or readout would be advantageously positioned with the major related elements in parallel relationship with the Y-Y' axis.

Figure 5:
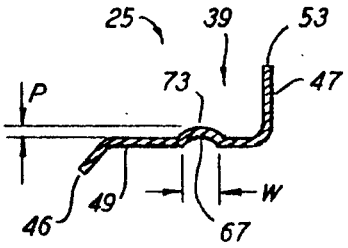
FIG. 5 is a cross-sectional view of the corner of the framing member taken along the line 5—5 in FIG. 4.
Figure 6:
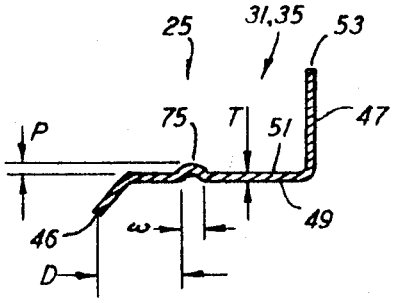
FIG. 6 is a cross-sectional view of the major and minor dimensionally related elements of the framing members taken along the dual lines 6—6 in FIG. 2.

The framing member 25 is cross-sectionally delineated as a substantially L-shaped configuration exhibiting a substantially formed ledge portion 45 which is instanding from an integral edge-related perimetrical upstanding sidewall portion 47. The inner edge 46 of this ledge defines the central opening of the framing member. The ledge portion has an exterior surface 49 and an interior surface 51 from which the sidewall portion 47 is in substantially perpendicular relationship, as shown in FIGS. 1, 5, and 6. The sidewall portion is terminally contoured 53 to mate with the peripheral shaping of the multi-opening mask member 27, which is subsequently positioned thereupon and affixed thereto as by the application of a multiplicity of welds 55 thereabout.

Figure 3:
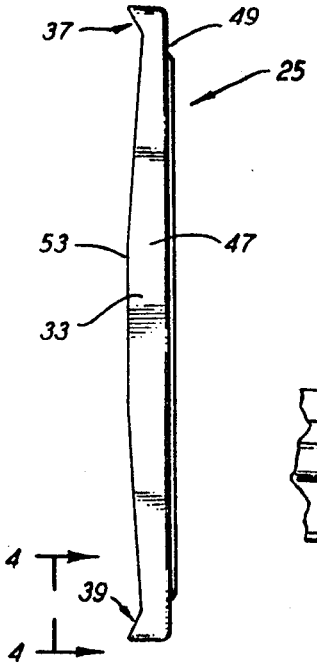
FIG. 3 is an end view of the framing member taken along the line 3—3 in FIG. 2.
Figure 4:
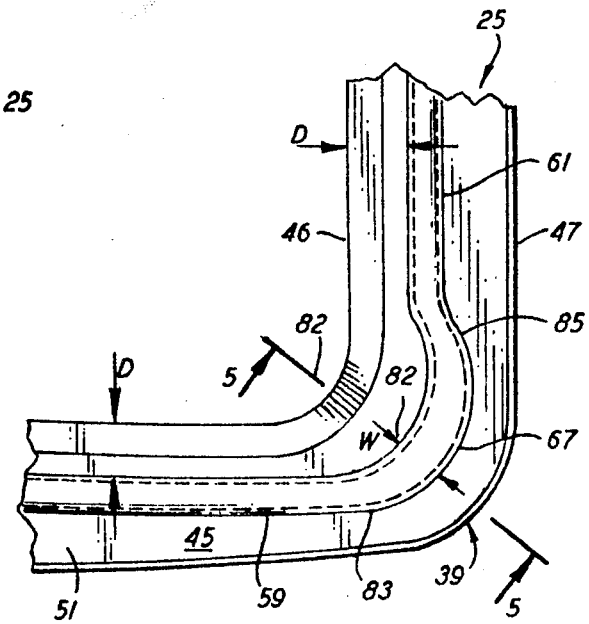
FIG. 4 is an enlarged view of a corner section of the framing member in the area designated 4—4 in FIG. 3.

As evidenced in FIGS. 2, 3, and 4, the inherent constructional shaping of both the ledge 45 and sidewall 47 portions of the framing member produces a designed reduction of material in the corner regions 37, 39, 41, and 43. This reduction of material and the drawn shaping of the framing member conjunctively produce corner regions that are structurally weaker than the other areas of the frame. As previously mentioned, the material stresses induced by the fabrication drawing procedures often impart a twisting or warping influence to the vulnerable corner and immediately adjacent regions.

The invention is directed to structural improvement means for perimetrically strengthening mask framing members, particularly larger sizes, such as those utilized in 19 and 25 inch tubes, whereby improved rigidity is imparted to the corners and the associated peripherally-related regions. Such structural strengthening means are comprised of longitudinal channel-like indentations 57, 59 formed in the ledge portions of the respective major related elements 29, 31, and longitudinal channel-like indentations 61, 63 formed in the ledge portions of the respective minor related elements 33, 35. These respective indentations are oriented to extend toward the respective corner regions 37, 39, 41, and 43 of the framing member, whereat "S"-like arcuate corner channel-like indentations 65, 67, 69, and 71 are formed and oriented to merge with the respective ends of the major and minor related channels to form a continuous channel indentation.

All of the channel indentations are of substantially arcuate cross-sectional configurations, being free of any angular manifestations. As shown, the indentations are formed inward from the exterior surface 49 of the ledge portion 45. Each of the channels evidences defined width and depth dimensions and a complementary protrusion projecting from the opposed interior surface 51 of the respective ledge portion. Such protrusions are exemplarily shown in FIGS. 5 and 6 as 73 and 75 respectively. As indicated, they project the distance "P" from the interior surface of the ledge portion 49, which is a dimensional value exceeding the thickness "T" of the ledge material. If desired, the channel-like indentations can be formed outward from the interior surface 51 of the ledge, whereupon the complementary protrusions will be evidenced as projecting from the exterior surface 49 thereof.

As delineated in FIG. 2, all of the channels are sequentially joined to form a continuous channel thereby providing a markedly improved strengthening structure, which greatly enhances the rigidity of the framing member. It has been found structurally advantageous to have each of the respective major and minor related channel-like indentations 57, 59, 61, and 63 oriented in the respective ledge portion 45 in substantially equispaced adjacency to the inner edge 46 of the ledge. Such is indicated by the dimensioning "D".

While the plurality of associated channel-like indentations are usually joined to form a continuous channel, there may be occasions in some tube constructions when it is deemed necessary to incorporate several optional short discontinuances 79 in selected areas of the major or minor related channels. Such discontinuances permit the formation of apertures 81 in the ledge to accommodate anchoring means for the subsequent addition of beam shields to the mask-frame assembly. Such exemplary optional discontinuances and apertures are referenced in FIG. 2 as broken-line delineations. When this modified construction is utilized, the respective minor related indentations 61 and 63 are each joined by means of their respective corner channel-like indentations 65, 67 and 69, 71, to the respective shortened end portions of the two major related channel-like indentations.

The corner "S"-like indentations are important links in the strengthening channel construction. Each of the corner channels is formed as a substantially laterally expanded arcuate accentuation of part of the "S" with the convex side thereof directed toward the outer peripheral edge of the framing member as illustrated. With particular reference to FIG. 4, there is shown the constructional form and advantageous positioning of an exemplary corner indentation 67 in the corner region 39 of the framing member. It is to be noted that the "S"-like channel increases in width to substantially the mid point 82 thereof, whereat its greatest breadth is indicated by "W". In comparing FIGS. 5 and 6, it is evident that the width "W" of each corner channel-like indentation is greater than the normal width dimensions "w" of each of the exemplary associated major and minor related indentations 59 and 63, as shown in cross-section along dual lines 6—6 in FIG. 2. It has been found that this greater breadth "W" in the central portion of the corner channel increases the strength of the construction in that region. Furthermore, the gradual decrease in width therefrom to the jointure regions 83 and 85 is also considered beneficial to achieving the desired rigidity. While there is the aforenoted difference in channel widths, the projection dimensions "P" of the respective complementary protrusions 73 and 75 are of substantially the same value, therefore the continuous channel indentation is of substantially uniform depth throughout.

The arcuate curvature of the corner indentation follows, in a general congruous manner, the arcuate flow lines of the formed metal in the corner region thereby effecting a strengthening influence thereat. Additional strengthening is achieved by the discrete jointures with the respective major and minor related channels 59 and 61. The merging of the major related channel 59 with the corner channel 67 is accomplished in a substantially tangential relationship at the jointure region 83 whereat the "D"-spatially-oriented major related channel effects a straight-on strengthening transition with the associated end of the arcuate corner channel. The respective "D"-spatially-oriented minor related channel-like indentation 61 is effectively merged with the associated end of the corner channel by a substantially tangential strengthening relationship at the jointure region 85. Thus, the perimetrical channeled structural improvement effected by the invention provides markedly enhanced rigidity for mask framing members, and is especially applicable to those employing lengthy major and minor structural elements.

What is claimed:

1. A structural improvement in the metallic framing member of a substantially rectangular multi-opening mask-frame assembly of the type positioned in a color cathode ray tube in spaced relationship within the viewing panel thereof adjacent to the cathodoluminescent screen disposed thereon, said framing member being an integration of major dimensionally-related elements and minor dimensionally-related elements transitionally combined at corner regions to provide a continuous perimetrical mask supporting structure having X and Y axes of reference therethrough; said member evidencing a substantially L-shaped cross-sectional configuration having a formed ledge portion instanding from an integral outer edge-related perimetrical upstanding sidewall portion, said ledge portion evidencing an exterior surface and an interior surface from which said sidewall portion is in substantially perpendicular relationship; said ledge having a continuous inner edge defining the opening of said framing member; said sidewall having a terminal contoured surface whereupon the multi-opening member of said mask-frame assembly is subsequently positioned and affixed, said structural improvement being means for perimetrically strengthening said framing member and comprising:

a longitudinal channel-like indentation formed in the ledge portion of each of the major and minor related elements in a manner to extend toward the corner regions of said framing member, the ends of said respective major and minor related channel-like indentations being joined at the respective corner regions of said framing member by an "S"-like arcuate corner channel-like indentation so positioned to merge with the respective ends of said major and minor related channels to form a continuous channel-like indentation in each corner region.

2. The structural improvement in the framing member of the CRT mask-frame assembly according to claim 1 wherein a portion of each of said corner "S"-like channel indentations is formed as a substantially laterally expanded arcuate accentuation directed toward the outer peripheral edge of said framing member.

3. The structural improvement in the framing member of the CRT mask-frame assembly according to claim 1 wherein each of the channel-like indentations produces a complementary protrusion projecting from the opposed surface of the ledge portion, said protrusion exceeding the thickness of the ledge material.

4. The structural improvement in the framing member of the CRT mask-frame assembly according to claim 1 wherein each of said channel-like indentations is formed inward from the exterior surface of said ledge portion.

5. The structural improvement in the framing member of the CRT mask-frame assembly according to claim 1 wherein each of said channel-like indentations is formed outward from the interior surface of said ledge portion.

6. The structural improvement in the framing member of the CRT mask-frame assembly according to claim 1 wherein each of said channel-like indentations is of substantially arcuate cross-section evidencing defined width and depth dimensions.

7. The structural improvement in the framing member of the CRT mask-frame assembly according to claim 6 wherein the width dimension of each corner channel-like indentation, at substantially the mid point thereof, is greater than the normal width dimensions of the associated major and minor related channel-like indentations.

8. The structural improvement in the framing member of the CRT mask-frame assembly according to claim 1 wherein the respective major and minor related channel-like indentation merge with the adjoining arcuate corner channel-like indentations in a substantially tangential relationship.

9. The structural improvement in the framing member of the CRT mask-frame assembly according to claim 1 wherein all channel-like indentations are sequentially joined to form a continuous channel.

10. The structural improvement in the framing member of the CRT mask-frame assembly according to claim 9 wherein said continuous channel-like indentation evidences short discontinuances at selected areas to accommodate the inclusion of apertures for beam shield anchoring means in the ledge of said framing member.

11. The structural improvement in the framing member of the CRT mask-frame assembly according to claim 10 wherein each of the minor related channel-like indentations is joined, by means of two corner channel-like indentations, to end portions of the two major related channel-like indentations.

12. The structural improvement in the framing member of the CRT mask-frame assembly according tc claim 1 wherein each of said major and minor related channel-like indentations is oriented in a respective ledge portion in substantially equi-spaced adjacency tc the respective inner edge thereof.

* * * * *